United States Patent [19]

Volpe

[11] 3,986,532

[45] Oct. 19, 1976

[54] WEFT EXTENDING CARRIER

[75] Inventor: Richard L. Volpe, Hopedale, Mass.

[73] Assignee: Rockwell International Corporation, Pittsburgh, Pa.

[22] Filed: Sept. 23, 1975

[21] Appl. No.: 616,086

[52] U.S. Cl. ..... 139/448

[51] Int. Cl.[2] ..... D03D 47/20

[58] Field of Search ..... 139/122 N, 122 R, 123, 139/127 R, 443–448

[56] References Cited

UNITED STATES PATENTS

| | | | |
|---|---|---|---|
| 3,347,284 | 10/1967 | Kokkinis | 139/122 N |
| 3,532,136 | 10/1970 | Golobart | 139/122 N |
| 3,638,686 | 2/1972 | Sole et al. | 139/122 N |
| 3,662,785 | 5/1972 | Kokkinis | 139/122 N |
| 3,927,699 | 12/1975 | Volpe | 139/122 N |

FOREIGN PATENTS OR APPLICATIONS

| | | | |
|---|---|---|---|
| 716,906 | 10/1966 | Italy | 139/122 N |

*Primary Examiner*—James Kee Chi

[57] ABSTRACT

A weft extending carrier for shuttleless looms adapted to insert single picks of weft into separate sheds formed by warp threads. The carrier is provided with an elongated weft finger mounted for pivotal movement within the carrier which receives and grips weft introduced by a companion carrier while extending the same through the remainder of the shed. The elements forming the surfaces between which the weft is gripped, are arranged and have a configuration which prevents the accumulation of lint or foreign matter therebetween and provides a device for assuring positive gripping of the weft during each picking cycle.

2 Claims. 5 Drawing Figures

WEFT EXTENDING CARRIER

BACKGROUND OF THE INVENTION

1. Field of the Invention

In shuttleless looms which utilize weft yarn that is furnished from an outside source and is not carried to and fro through the shed by the shuttle or carrier itself, it is common practice to insert each pick of weft by two reciprocating elements. That element which introduces the weft into the warp shed is known as the inserting carrier and that which receives or has transferred to it the introduced weft to be drawn through the remainder of the shed is known as the weft receiving or extending carrier.

The shuttleless loom to which the instant invention is applicable is of the single pick insertion type wherein the weft yarn remains threaded through an eyelet in the rear wall of the inserting carrier and extends in one direction to its source and in the other direction to the selvage or fabric edge. When forming single picks the weft yarn must be clamped, held, then cut adjacent the shed each time the inserting carrier is withdrawn from the shed. During the initial movement of the inserting carrier to introduce a pick of weft, the latter is located in such a manner so as to be caught by a clamping element in the forward wall of the inserting carrier and the clamped weft is then released to permit said carrier to carry the cut end of weft into the shed and present it to the extending carrier. In particular the invention pertains to an improved extending carrier for receiving an end of weft from the inserting carrier and to draw the same through the shed to complete a single pick.

2. Description of the Prior Art

The known forms of weft extending carriers for shuttleless looms of the pick and pick insertion type have an elongated configuration with upper and lower surfaces disposed in spaced and aligned relation which join at the carrier's leading end to form a weft engaging hook. At the opposite or trailing end of the carrier the upper surface tapers downwardly and joins the lower surface to form a means for deflecting the warp yarns during withdrawal of the carrier from a warp shed. In the space intermediate the upper and lower surfaces, the carrier is provided with a gripper finger pivotably assembled intermediate its ends and extends for substantially the length of the space provided between said surfaces.

A biasing means continuously urges the forward end of the gripper finger into contact with the weft engaging hook of the carrier, the combination of which includes a tongue and groove arrangement for holding the pick of weft as it is extended through the shed. The tongue portion of the combination forms an integral part of the finger and the groove of conforming configuration is formed on the inner side of the hook. A lip is provided at the trailing end of the gripper finger which protrudes from the side of the carrier and serves in a known manner as a means for effecting pivotal movement of the gripper finger so as to release the weft held thereby in timed sequence with the weaving cycle.

This form of extending carrier has performed its intended function satisfactorily; however, certain types of weft yarns have presented problems which create undesirable conditions and which are time consuming to correct. Weft yarns having lint shedding characteristics such as those spun from natural fibers or poor quality yarn containing slubs as well as low twist and low count yarns have been the most troublesome in extending carriers which utilize the tongue and groove arrangement for gripping the weft. Lint as well as other foreign matter has a tendency to collect in the groove portion of the weft gripping arrangement and with the tongue portion being continuously moved into and out of the groove, the collected lint becomes packed in the groove to the extent where the tongue will no longer fully seat therein. When such a condition occurs, the ability to satisfactorily grip the weft is lost requiring shut down of the loom until the condition is corrected.

The weft extending carrier of the present invention provides a weft gripping arrangement which will accommodate all types of weft yarns and is of the self-cleaning type which will not permit the accumulation of lint or other foreign matter.

SUMMARY OF THE INVENTION

The weft extending carrier according to the present invention is generally of conventional configuration having a base portion which attaches to a reciprocable inserter member and an elongated shank extending outwardly from the base portion away from the inserter member. The shank includes a centrally disposed recess which extends substantially the full length thereof, and within which an elongation weft finger is mounted for pivotal movement.

The leading end of the carrier has a weft engaging tip that includes a laterally extending upper surface defining a hook the underside of which is provided with a weft clamping surface of stepped configuration located in alignment with and spaced from the recess in the elongated shank. That end of the weft finger adjacent the carriers leading end is provided with a horizontally disposed and laterally extending lip which is formed generally to the configuration of the weft clamping surface and is movable with the weft finger to and from engagement with said weft clamping surface. An arcuated web interconnects the laterally extending upper surface of the carrier with the lower and inner side surface of the elongated shank and serves as a means for locating the weft, when the latter is transferred from the inserting carrier, so that it will be caught and held by the gripping element.

It is a general object of the invention to improve the general construction and operational characteristics of the weft extending carrier herein described.

A further object of the invention is to provide an extending carrier having means for preventing the accumulation or lint and other foreign matter within the weft gripping elements thereof.

It is a further object to provide an extending carrier which is capable of accommodating a greater number of types of weft yarn than has been possible with known types of extending carriers.

These and other objects of the invention will become more fully apparent by reference to the appended claims and as the following detailed description proceeds in reference to the figures of drawings wherein:

DESCRIPTION OF THE PREFERRED EMBODIMENT

Now referring to the figures of drawing inserters or flexible tapes 10 are used to reciprocate the weft carrying members themselves which are caused to enter the shed and to be withdrawn therefrom. The tapes are projected into the shed to a point approximately adjacent the center thereof at which the weft extending carrier meets the inserting carrier to transfer the weft yarn to be drawn through the remainder of the shed.

Figure 1:
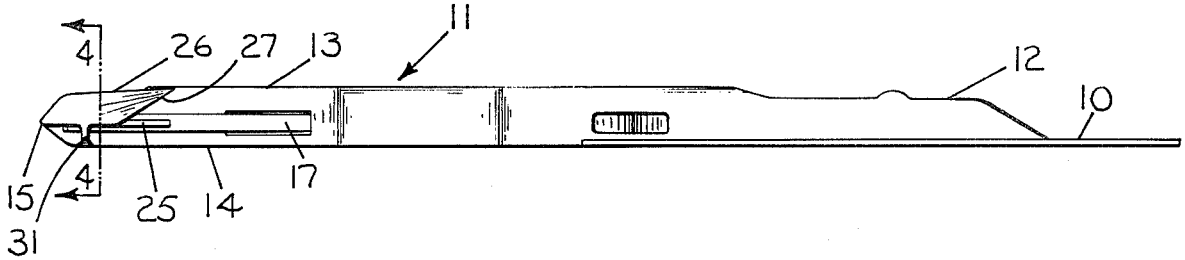
FIG. 1 is a view in side elevation showing the improved weft gripping means according to the invention applied thereto.
Figure 2:
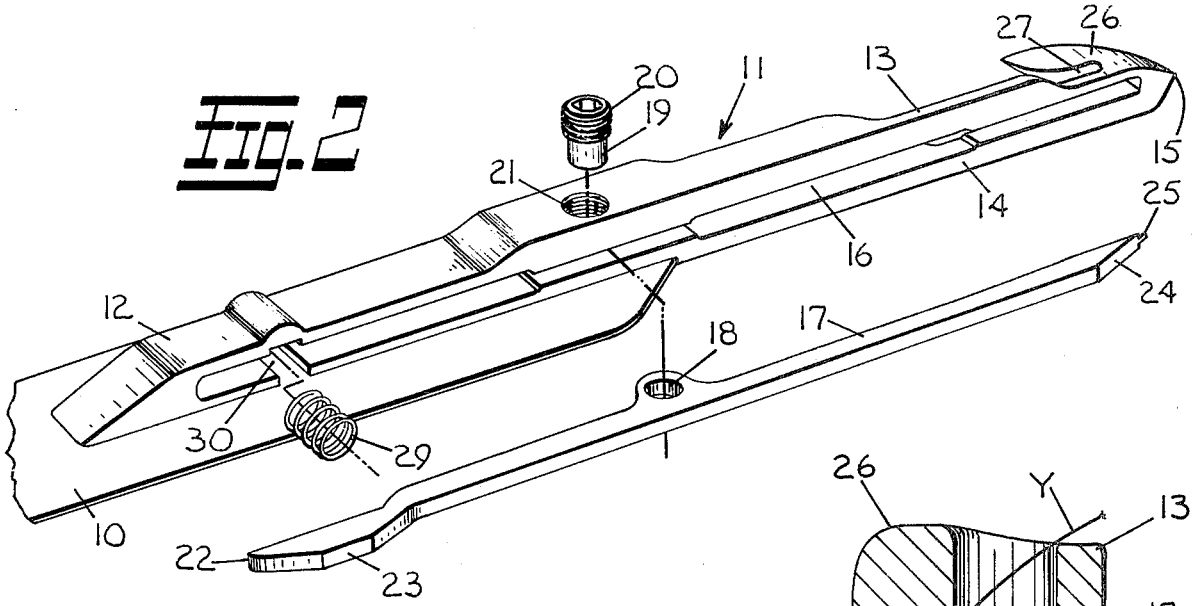
FIG. 2 is a perspective view in exploded form showing greater detail of the carrier in FIG. 1.
Figure 3:
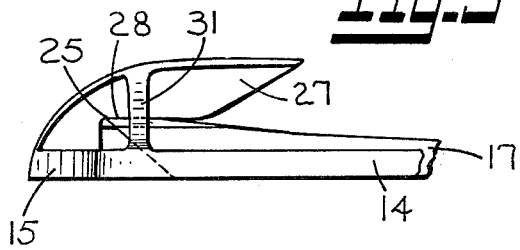
FIG. 3 is a bottom view of the leading end of the extending carrier.

Attached by some suitable means to the tape 10 is a weft receiving or extending carrier generally indicated by numeral 11 (FIGS. 1 and 2). In these figures of drawing the carrier's base portion is identified by numeral 12 and includes an elongated shank that defines a top and bottom surface 13 and 14 respectively extending therefrom. Spaced from the base portion 12, the top and bottom surfaces 13 and 14 are interconnected to form the carrier's leading end or weft engaging tip 15. The space intermediate the top and bottom surfaces defines an elongated opening or recess 16 (FIG. 2) within which an elongated weft finger 17 is pivotably mounted. This elongated weft finger is provided with an aperture 18 (FIG. 2) intermediate its ends which in assembled position within recess 16 is adapted to receive the shank portion 19 of a threaded pin 20 that assembles in a threaded hole 21 provided in the top surface 13 and serves as a fulcrum about which said weft finger is caused to pivot.

The trailing end of the weft finger is that end identified by numeral 22 in FIG. 2 and includes an offset portion 23 which protrudes from the side of the carrier. This offset portion 23 is acted upon in a known manner by a fixed element on the loom (not shown) to pivot the weft finger and release the weft held thereby in timed sequence with the weaving cycle. The leading or forward end of the weft finger 17 is identified by numeral 24 (FIG. 2) and includes a weft engaging member having a configuration that defines a horizontally disposed and laterally extending lip 25 that forms a part of the weft gripping arrangement now to be more fully described.

Figure 4:
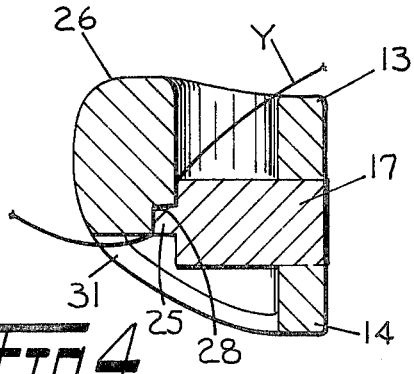
FIG. 4 is a sectional view of the carrier as seen looking in the direction of the indicating arrows of line 4—4 in FIG. 1 showing the weft engaging member in that position for gripping the weft.
Figure 5:
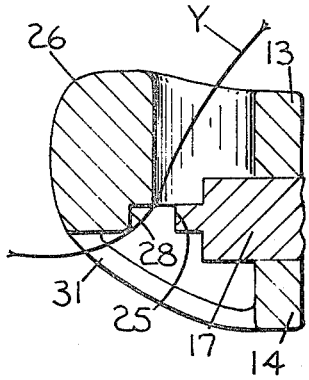
FIG. 5 is a view similar to that of FIG. 4 but showing the weft engaging member in that position for releasing the weft.

The weft engaging tip 15 is provided with a laterally extending upper surface 26 which extends outwardly and thence rearwardly from the top surface 13 forming a hook 27 into which weft identified by the letter Y is adapted to pass when received from the weft inserting carrier. The underside of the laterally extending upper surface 26 is provided with a weft clamping surface 28 (FIGS. 4 and 5) having a stepped configuration that is spaced from and in horizontal alignment with recess 16 formed between the top and bottom surfaces 13 and 14. The laterally extending lip 25 on the weft finger 17 is movable into and from engagement with the weft clamping surface 28 as shown in FIGS. 4 and 5 respectively and provides the means for gripping and releasing the weft. Lip 25 is continually urged toward the weft clamping surface 28 by means of a coil spring 29 which assembles in a recess 30 formed in the base portion 12 of the carrier. One end of coil spring 29 seats against the inner end of recess 30 and the opposite end is caused to bear against the inner side of the offset portion 23 of the weft finger 17.

To prevent the weft from moving beyond the limits of the lip 25 and the clamping surface 28 after its transfer from the inserting carrier, an arcuated web 31 interconnects the underside of the laterally extending upper surface with the lower and inner side wall of the lower surface 14 of the elongated shank.

To summarize the operation the extending carrier enters the warp shed and meets the inserting carrier adjacent the center thereof. When the two carries meet, the end of weft Y introduced by the inserting carrier slides over the laterally extending upper surface 26 and into the hook 27. As the extending carrier reverses its direction of travel, the weft Y becomes wedged between the weft clamping surface 28 and the laterally extending lip 25. The arcuated web 31 interconnects the laterally extending surface 26 with the lower and inner side wall of the lower surface 14 and is disposed so as to prevent the weft Y from being drawn into the hook 27 beyond the gripping area of the clamping surface 28 and lip 25. Additionally the gripping area being in the form of a stepped surface provides no areas within which lint or other foreign matter can accumulate and provides a continuous and positive gripping arrangement that can accommodate a substantially greater variety of types of weft than has been heretofor possible.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. An improved weft extending carrier for a loom having weft carriers attached to reciprocable inserter members by which weft from an outside source of supply is inserted as single picks into separate sheds of warp threads, the extending carrier receiving an end of weft from an inserting carrier and extending the end of weft across the remainder of the shed, said extending carrier comprising:

a. a base portion for attachment to a reciprocable inserter member;

b. an elongated shank extending outwardly from said base portion away from the inserter member, said elongated shank having means defining a recess which extends substantially the entire length thereof;

c. a weft engaging tip forming one end of said elongated shank, said weft engaging tip including 1. a laterally extending upper surface defining a hook with a weft clamping surface of stepped configuration forming the under and inner side thereof;

d. an elongated weft finger mounted for pivotal movement within said recess, said elongated weft finger including:

1. a weft engaging member defining a horizontally disposed and laterally extending lip movable with said finger into and from engagement with said weft clamping surface for gripping weft therebetween and releasing the same therefrom; and e. means interconnecting said hook with said elongated shank for positioning the weft held between said weft clamping surface and said weft engaging member.

2. The weft extending carrier according to claim 1 wherein said positioning means defines an arcuated web extending from the underside of said laterally extending upper surface to the lower and inner side surface of said elongated shank.

* * * * *